US006009641A

United States Patent [19]

Ryan

[11] Patent Number: 6,009,641

[45] Date of Patent: Jan. 4, 2000

[54] TORSIONALLY FLEXIBLE CYCLING SHOE

[75] Inventor: Kevin Ryan, Jakarta, Indonesia

[73] Assignee: adidas International, B.V., Netherlands

[21] Appl. No.: 09/155,872

[22] PCT Filed: Feb. 5, 1998

[86] PCT No.: PCT/EP98/00623

§ 371 Date: Oct. 16, 1998

§ 102(e) Date: Oct. 16, 1998

[87] PCT Pub. No.: WO98/34507

PCT Pub. Date: Aug. 13, 1998

[30] Foreign Application Priority Data

Feb. 6, 1997 [DE] Germany ..... 297 02 071

[51] Int. Cl.[7] ..... A43B 5/00; A43B 13/14; A43B 23/00

[52] U.S. Cl. ..... 36/131; 36/31; 36/107

[58] Field of Search ..... 36/131, 31, 107, 36/108, 76 R

[56] References Cited

U.S. PATENT DOCUMENTS

| | | | |
|---|---|---|---|
| 4,922,631 | 5/1990 | Anderié | 36/76 R |
| 5,086,576 | 2/1992 | Lamson | 36/131 |
| 5,452,526 | 9/1995 | Collins | 36/108 X |
| 5,473,827 | 12/1995 | Barre et al. | 36/31 X |
| 5,657,558 | 8/1997 | Pohu | 36/131 |
| 5,832,634 | 11/1998 | Wong | 36/107 |

FOREIGN PATENT DOCUMENTS

| | | | |
|---|---|---|---|
| 0 726 037 A3 | 8/1996 | European Pat. Off. . | |
| 91009547 | 7/1991 | WIPO | 36/107 |
| WO 96 10346 A2 | 4/1996 | WIPO . | |

*Primary Examiner*—B. Dayoan
*Attorney, Agent, or Firm*—Testa, Hurwitz & Thibeault, LLP

[57] ABSTRACT

A cycling shoe includes an external frame for supporting the upper, the frame having a forefoot portion, a heel portion and a bottom member connecting the heel and forefoot portions, having torsional flexibility, the heel portion being axially rotatable relative to the forefoot portion responsive to vertical out of plane movement of the cyclist's leg, a medial side member extending between the forefoot portion and the heel portion, a lateral side member extending between the forefoot portion and the heel portion, and having a resistance to horizontal and vertical displacements of the heel portion relative to the forefoot portion.

5 Claims, 2 Drawing Sheets

TORSIONALLY FLEXIBLE CYCLING SHOE

The present invention relates to cycling shoes, in particular to cycling shoes, which allow an axial rotation between the heel portion and the forefoot portion.

BACKGROUND OF THE INVENTION

Cycling shoes having an upper mounted on a bottom plate are well-known. The bottom plate is provided to permit rigid attachment of the shoe to lugs on the pedal, and to provide the shoe with the required vertical and lateral stiffness for efficient riding. In particular, during the rotation of the pedals, the rider transmits numerous forces to the pedals through the shoes. Readily apparent are the vertical forces which drive the pedals. Less apparent are lateral and torsional forces which result from the natural motion of alternately driving the right pedal and then the left pedal downwardly. In so doing, the rider's upper leg is repeatedly forced out of plane (in a vertical direction) relative to each pedal, and therefore relative to the foot, which is rididly attached to the pedal. The vertical misalignment between the rider's upper leg and the pedal is largely absorbed by the knee. The bending moment applied to the knee as a result of the rider's out of plane motion tires and wears on the knee.

While different cycling shoe designs are known, the prior art includes no shoe which effectively relieves the bending moment on the knee, while still providing the rigidity and strength required by the rider.

A need therefore remains for a cycling shoe which is strong and rigid in the lateral and vertical directions, and which at the same time provides the rider a measure of torsional flexibility to relieve the bending moment on the rider's knees.

SUMMARY OF THE INVENTION

The present invention is embodied in a cycling shoe having an upper supported in an external frame. The upper may include one or more encircling straps which can be adjusted to accommodate the rider's preferences. The frame includes a forefoot portion, a heel portion, an elongate bottom member connecting the forefoot and heel portions, a medial side member and a lateral side member. The bottom of the frame includes openings into which sole elements are inserted. The bottom plate is also torsionally flexible so that the heel can axially rotate relative to the forefoot responsive to vertical out of plane movement of a cyclist's leg. The medial and lateral side members accommodate the axial rotation, and at the same time provide vertical and lateral support for the frame and the rider's foot.

BRIEF DESCRIPTION OF THE DRAWINGS

The drawing shows a preferred embodiment of the present invention. In detail.

DETAILED DESCRIPTION OF THE INVENTION

In the following a preferred embodiment of the present invention is described in detail.

Figure 1:
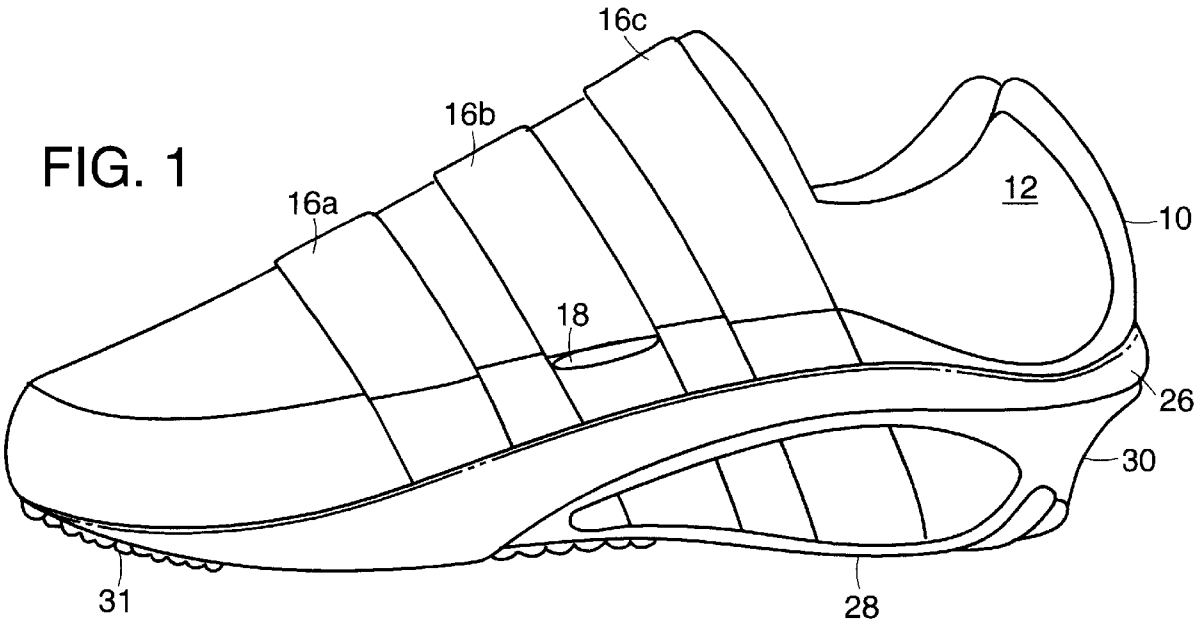
FIG. 1 is a side elevational view of a cycling shoe according to the present invention.
Figure 2:
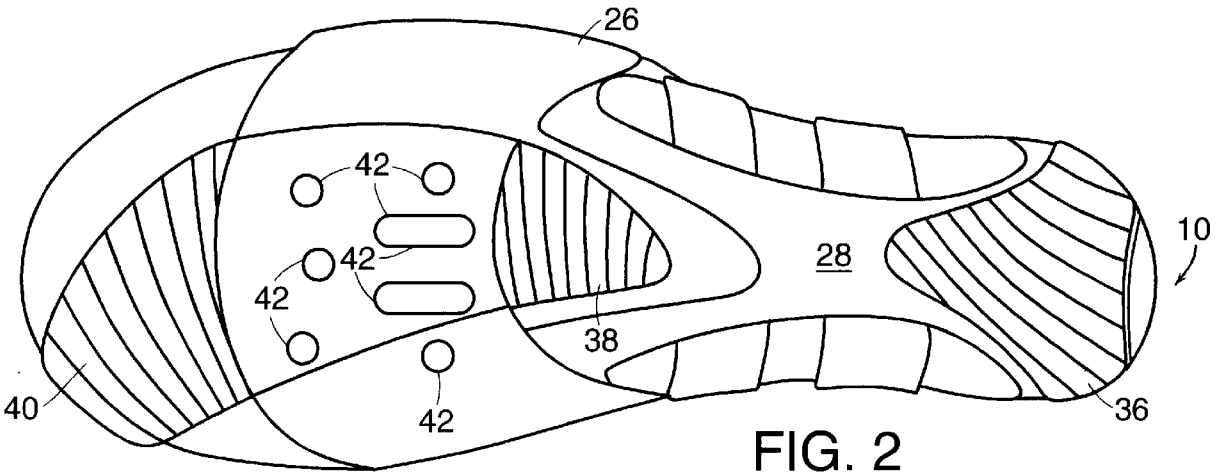
FIG. 2 is a bottom plan view of the shoe shown in FIG. 1.

Turning to FIGS. 1 and 2, a cycling shoe 10 according to the present invention includes an upper 12 which may be formed from any suitable natural or polymeric woven materials. Straps 16*a–c* are provided, which encircle upper 12 to secure the shoe onto the rider's foot, and may include an adjustable buckle 18 or other means such as hook and loop fastening material to provide adjustment of the strap according to the rider's preference. Upper 12 is preferably made to be as light as possible, and as a result, is very flexible. Owing to its flexibility, upper 12 provides very little support for a rider's foot.

Figure 3:
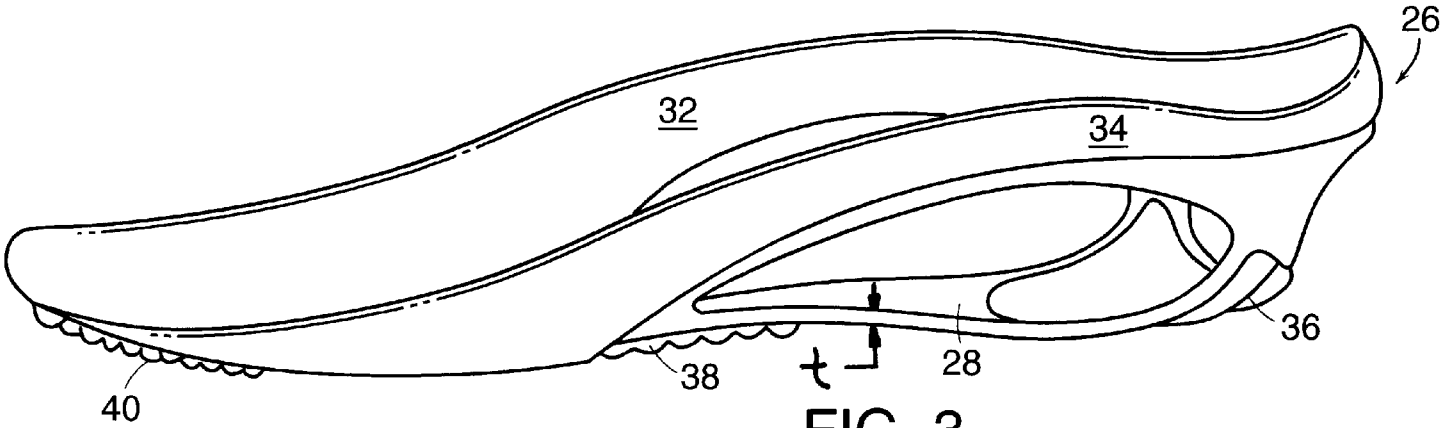
FIG. 3 is a side elevational view of only the frame of the cycling shoe shown in FIG. 1.
Figure 4:
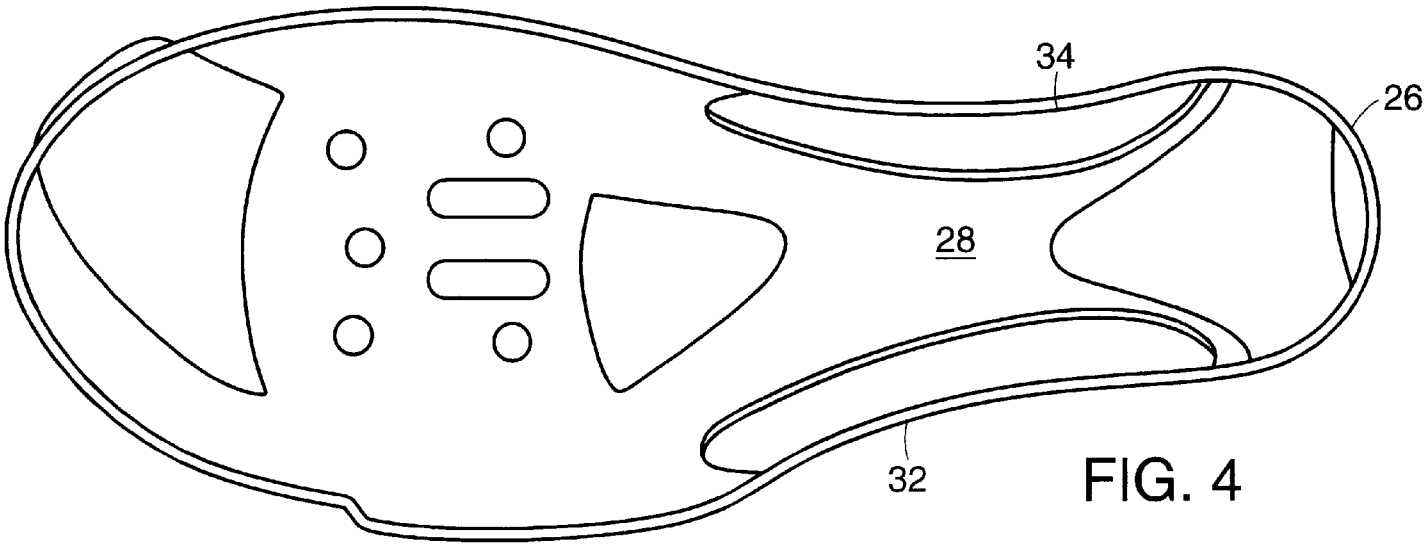
FIG. 4 is a bottom plan of the frame shown in FIG. 3.

Upper 12 is therefore supported within frame 26 which includes a bottom plate 28, a heel portion 30, a forefoot portion 31, a lateral member 32 and a medial member 34 (FIGS. 3 and 4).

Frame 26 is preferably made of a polymeric material to achieve the desired combination of low weight and high strength.

Abrasion resistant sole elements 36, 38 and 40 are inserted into corresponding openings in bottom plate 28, as best seen in FIGS. 2 and 4. Holes 42 are provided in bottom plate 28, and engage corresponding lugs on a bicycle pedal. Engagement of the holes 42 with the pedal lugs securely locks the frame and the shoe to the pedal as required to transmit the forces from the rider to the pedal.

In prior art cycling shoes, the bottom plate must be sufficiently stout, i.e. strong, to withstand the significant vertical and lateral forces exerted through the shoe to the pedal. As a result, the bottom plate of prior art cycling shoes is also highly resistant to axial twisting, and holds the rider's heel and forefoot in a nearly fixed rotational position one relative to the other. When the rider's heel and forefoot are held rigidly in axial alignment, a rider's natural vertical out-of-plane movements must be absorbed largely by the rider's knees. The resulting bending moment applied to the rider's knees is a significant source of fatigue and wear and tear on the rider's knees.

In one aspect of the present invention, the bending moment applied to the rider's knees is greatly reduced because bottom plate 28 is sufficiently flexible to permit the rider's heel to axially rotate relative to the forefoot. The rotation of the rider's heel allows the lower and upper legs to remain in closer alignment throughout the full pedal rotation, particularly when the rider is standing and pedalling. Referring again to FIGS. 3 and 4, bottom plate 28 is waisted in the area immediately ahead of the heel. This waisted area of the bottom plate, in combination with a relatively small thickness t, permits the rider's heel to axially rotate relative to the forefoot as the rider alternatively bears on the right and left pedals. Lateral and medial members 32 and 34, which extend from the heel portion to the forefoot of frame 26, accommodate the forementioned axial rotation and at the same time enable frame 26 to withstand the lateral and vertical forces applied by the rider. As an added benefit, it has to be mentioned that lateral and medial members 32 and 34, and heel portion protect the rider's foot during falls or collisions.

The present invention thereby improves upon the prior art by providing a cycling shoe which reduces the bending moment on the rider's knees, provides high vertical and lateral strength, and provides added protection for the rider's foot during falls or collisions. p Those skilled in the art of sport shoes in general and cycling shoes in particular, will recognize that the foregoing exemplary embodiments can be modified in detail and arrangement without departing from the scope of the following claims.

I claim:

1. A cycling shoe comprising:

an upper;

an external reinforcing frame supporting the upper, the reinforcing frame having a forefoot portion, a heel portion, an elongate bottom member connecting the forefoot and heel portions and having a torsional flexibility, the heel portion being axially rotatable relative to the forefoot portion responsive to vertical out of plane movement of a cyclist's leg;

a medial side member extending between the forefoot and heel portions and having a resistance to horizontal and vertical displacement of the heel portion relative to the forefoot portion; and a lateral side member extending between the forefoot and heel portions and having a resistance to horizontal and vertical displacement of the heel portion relative to the forefoot portion.

2. The cycling shoe of claim 1 further comprising at least one circumferential strap extending at least partially about the upper.

3. The cycling shoe of claim 2 wherein the at least one circumferential strap includes a portion disposed between the upper and the reinforcing frame.

4. The cycling shoe of any of the preceding claims wherein the frame includes surfaces defining at least one opening in the bottom member, and resilient, abrasion resistant sole element disposed in the at least one opening.

5. The cycling shoe of claim 1 wherein the bottom member of the frame includes surfaces defining a plurality of openings for receiving pedal lugs.

* * * * *